United States Patent [19]

Englehart et al.

[11] Patent Number: 4,872,589

[45] Date of Patent: Oct. 10, 1989

[54] LINER/INSERT FOR REFRIGERATED CONTAINER

[76] Inventors: John D. Englehart, 44 S. State St., Vineland, N.J. 08360; William H. Seaburn, 5417 Duncanwood Dr., Sarasota, Fla. 34232

[21] Appl. No.: 182,338

[22] Filed: Apr. 18, 1988

[51] Int. Cl.[4] ..... B65D 90/04

[52] U.S. Cl. ..... 220/410; 62/371; 62/441; 220/22; 220/94 A; 220/94 R

[58] Field of Search ..... 62/371, 372, 444, 457, 62/465, 466; 206/541, 542, 545; 220/405, 408, 410, 21, 22, 94 A, 94 R, 403, 404

[56] References Cited

U.S. PATENT DOCUMENTS

| | | | |
|---|---|---|---|
| 1,287,892 | 12/1918 | Corson | 62/457 |
| 2,239,484 | 4/1941 | Cocks | 62/417 |
| 2,496,296 | 2/1950 | Lobl . | |
| 2,555,102 | 5/1951 | Anderson | 220/22 |
| 2,652,698 | 9/1953 | Schlumbohm | 206/545 |
| 3,401,535 | 9/1968 | Palmer | 62/457 |
| 3,605,431 | 9/1971 | Carson . | |
| 3,842,976 | 10/1974 | Dea | 220/21 |
| 3,887,103 | 6/1975 | Spooner | 220/94 A |
| 4,459,825 | 7/1984 | Crouch . | |
| 4,498,312 | 2/1985 | Schlosser . | |
| 4,499,998 | 2/1985 | Carlson . | |
| 4,509,587 | 4/1985 | Clark et al. . | |
| 4,538,727 | 9/1985 | Solloway | 220/94 A |
| 4,551,988 | 11/1985 | Petrantoni . | |
| 4,603,558 | 8/1986 | McAdams | 62/457 |
| 4,714,158 | 12/1987 | Oltman | 220/22 |
| 4,759,467 | 7/1988 | Byrne | 220/22 |

*Primary Examiner*—Jimmy G. Foster
*Attorney, Agent, or Firm*—Pitts and Brittian

[57] ABSTRACT

A combination liner/insert (10) for segregating a top opening refrigerated container (30) such as a portable ice chest into a plurality of watertight compartments (26') and for protecting the interior of the ice chest (30) against damage caused by substances or articles placed therein. The liner/insert comprises a liner (22) having a base (14) and walls (12) dimensioned for being received within the ice chest (30) and a partition 16 for segregating the liner into watertight compartments (26') and a handle (18) incorporated into the partition (16).

8 Claims, 5 Drawing Sheets

LINER/INSERT FOR REFRIGERATED CONTAINER

DESCRIPTION

Technical Field

This invention relates to a combination liner/insert for segregating a top-opening refrigerated container, such as a portable ice chest, into two or more watertight compartments. In this particular invention, the liner/insert includes a liner, one or more integrated partitions for segregating the liner into two or more compartments and a handle incorporated into at least one of the partitions for selectively inserting or removing the insert into or from the refrigerated container.

Background Art

Top-opening refrigerated containers, such as portable ice chests, have been known for many years. Portable ice chests have been popularly used by campers, picnickers, sportsmen and others for keeping food and drink cold and by medical personnel for keeping medical supplies at a desired temperature when conventional refrigerators are unavailable or impractical. While such ice chests have proven quite satisfactory for preserving the temperature or cooling of well sealed items such as bottles or cans of beverages, they have proven somewhat unsatisfactory when ice is used to keep loosely wrapped or uncontained food items such as sandwiches chilled, it being not uncommon for sandwiches and the like to become "soggy" as the ice melts.

Another common problem with respect to conventional ice chests is deterioration of the ice chest resulting from the melting ice and other damaging substances which have been placed in or leaked into the chest. Metal chests have been known to corrode completely through the interior liner. Plastic and plastic lined chests are susceptible to mildew and damage from substances placed in the chest. Drain plugs which are found in many ice chests may leak as a result of corrosion or damage caused by articles or substances placed in the chest. Plastic lined chests may also be damaged by ice picks or sharp articles placed in the chest.

In response to the problems encountered in ice chests as described above, a number of developments have occurred in the art. Many ice chest manufacturers provide food trays which rest in a portion of the top opening of the chest and extend partially down into the interior of the chest. While such trays help to alleviate the problem of the "soggy sandwich", they do little to protect the liner of the chest against damage caused by ice and other articles placed in the rest of the chest. Sealable water bottles which are frozen prior to use and other sealed ice substitutes have also been used to alleviate the problem of water-soaked food. An insert described as a "chambered cooler" is disclosed in prior art U.S. Pat. No. 4,551,988 dated Nov. 12, 1985, which deals with the problem of water-soaked food in conventional ice chests. However, nothing in the prior art adequately deals with both the problem of water-soaked food and the problem of deterioration of the interior liner caused by articles or substances placed in a conventional ice chest.

Therefore, it is an object of this invention to provide a combination liner/insert which alleviates the problems commonly found in conventional ice chests as discussed above which significantly advances the refrigerated container art.

Another object of this invention is to provide a liner/insert designed to segregate the cooling medium such as ice from the articles stored within an ice chest.

Another object of this invention is to provide a liner/insert which protects the interior liner of an ice chest against deterioration or damage caused by the cooling medium or other articles or substances placed in an ice chest.

Another object of this invention is to provide a liner/insert for an ice chest which is inexpensive to manufacture such that, if damaged, the liner/insert can be replaced at considerable savings over the replacement cost of the ice chest itself.

Another object of this invention is to provide a liner/insert for an ice chest which can be used to extend the life of an ice chest which has already been damaged or corroded, e.g., a metal chest which is badly rusted or a chest which leaks.

Another object of this invention is to provide a liner/insert which divides an ice chest into compartments for organization and separation of articles placed therein.

Another object of this invention is to provide a liner/insert for a refrigerated container which provides the previously described advantages with a minimum of storage space lost within the containe to the volume of the liner/insert itself.

DISCLOSURE OF THE INVENTION

Other objects and advantages will be accomplished by the present invention which provides a combination liner/insert for a top-opening refrigerated container such as a portable ice chest to protect the interior liner of the chest and to segregate the chest's interior volume into watertight compartments. The liner/insert of the present invention comprises a liner, partition(s) and handle(s). The liner comprises a base and walls which form a watertight container. In the preferred embodiment, the base and walls of the liner are dimensioned to permit the liner/insert to be closely received within a preselected ice chest, thereby providing a protective liner for the bottom and interior walls of the ice chest. The partition(s) is (are) a substantially planar portion which extends vertically from the base and from one wall inside the liner to an opposite wall inside the liner and is (are) sealably fixed thereto, i.e. its bottom and side edges are defined by the interior base and walls of the liner, thereby segregating the liner into a plurality of watertight compartments. The partition has a handle incorporated into it proximate its top edge.

BRIEF DESCRIPTION OF THE DRAWINGS

The above-mentioned features of the invention will become more clearly understood from the following detailed description of the invention read together with the drawings in which.

BEST MODE FOR CARRYING OUT THE INVENTION

Figure 1:
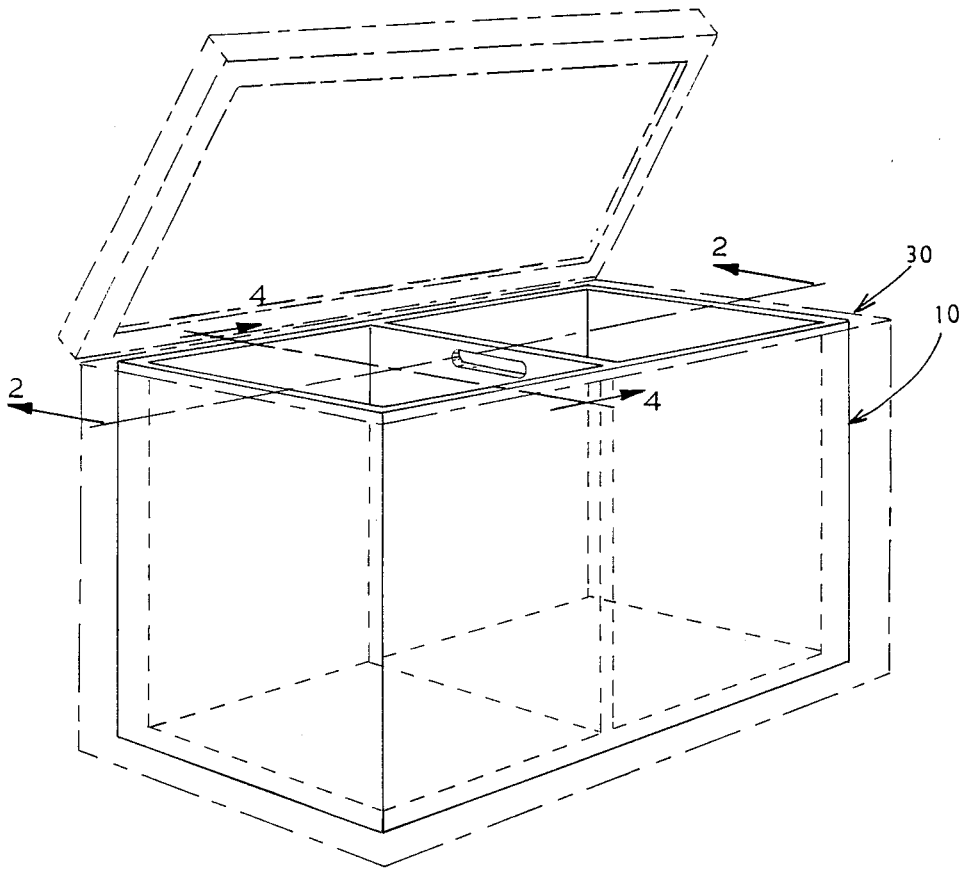
FIG. 1 illustrates a perspective view of a combination liner/insert constructed in accordance with various features of the present invention as it is installed in an ice chest (shown in phantom) and ready for use.
Figure 2:
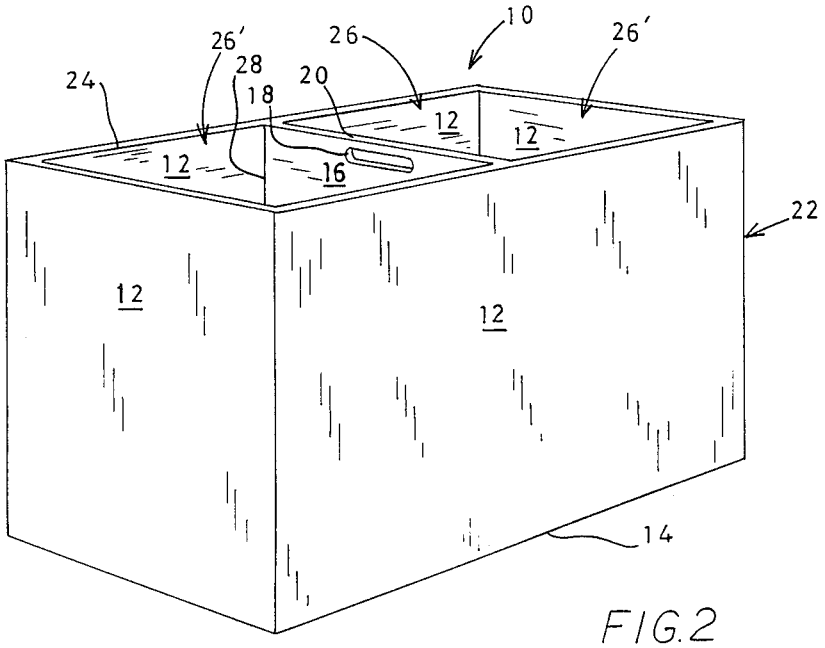
FIG. 2 illustrates a perspective view of a combination liner/insert constructed in accordance with various features of the present invention.
Figure 3:
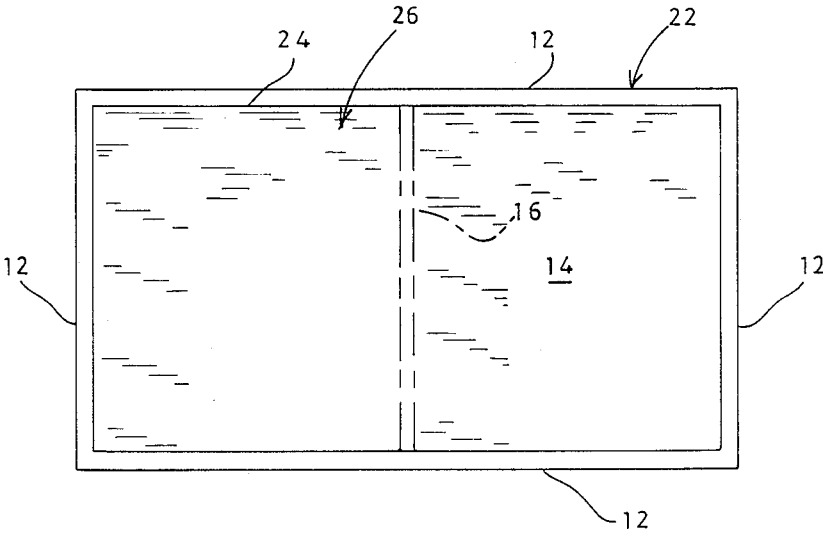
FIG. 3 illustrates a top view of the liner portion only of the present invention, with the partition shown in phantom.
Figure 4:
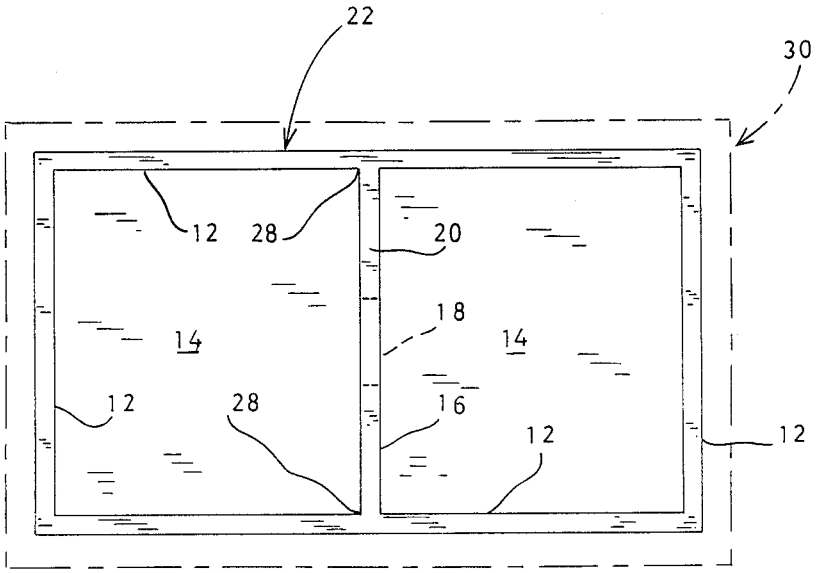
FIG. 4 illustrates a top view of FIG. 1 (shown with lid removed from ice chest)
Figure 5:
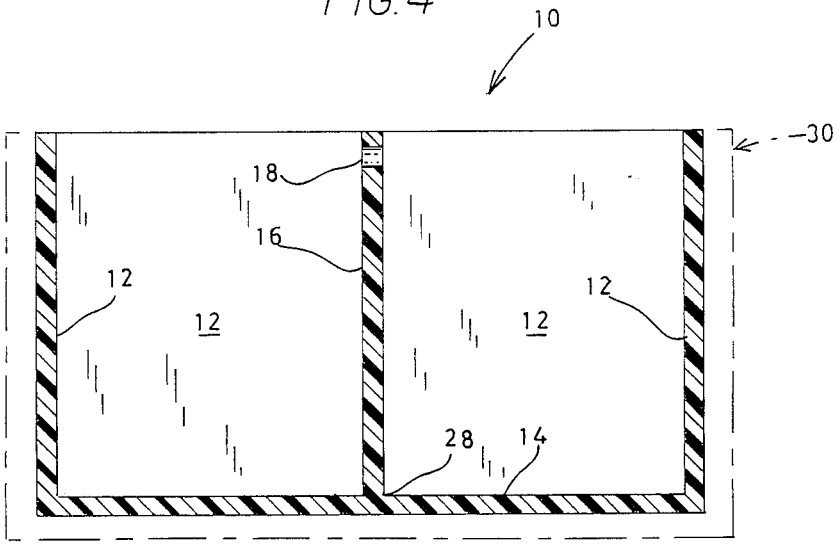
FIG. 5 illustrates a front elevation sectional view of FIG. 1 along lines 2—2 (shown with lid removed from ice chest)
Figure 6:
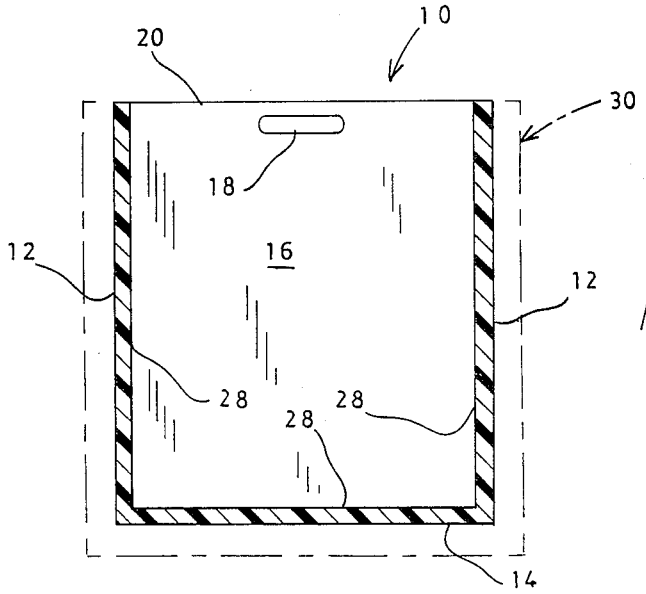
FIG. 6 illustrates a side elevation sectional view of FIG. 1 along lines 4—4 (shown with lid removed from ice chest)

A liner/insert for a refrigerated container such as an ice chest incorporating various features of the present invention is illustrated generally at 10 in the figures. The liner/insert includes a watertight liner 22 having a base 14 and upstanding walls 12 which define an opening 24 opposite the base 14 and an interior volume 26 as shown in FIGS. 2 and 3. In the preferred embodiment, the base 14 and the walls 12 are dimensioned such that the liner 22 will be closely received in a preselected ice chest shown generally at 30 in FIGS. 1 and 4 through 6.

A partition 16 is sealably connected to the base 14 of the liner 22 and extends perpendicularly toward the opening 24 and is sealably connected to the walls 12. This partition 16 has edges 28 defined by its connections to the walls 12 and base 14 of the liner 22 and a top edge 20 located proximate the opening 26. The partition 16 segregates the interior volume 26 of the liner 22 into a plurality of watertight compartments 26'. In the preferred embodiment, the partition 16 is located approximately halfway between two opposing end walls 12 of the liner 22.

The partition 16 includes a handle 18 located proximate the top edge 20 of the partition 16. In one embodiment, this handle comprises a hole in the partition, dimensioned to receive the fingers of a user's hand, while the thumb or heel portion of the hand engages the upper edge of the top edge 20, as will be recognized from FIGS. 1 through 7.

In the preferred embodiment of the invention, the liner and partition are constructed of integrally molded plastic. The walls and base of the liner and the partition are approximately 3/32 of an inch thick. This permits sufficient strength to contain the ice and water or other cooling medium when the liner/insert is removed from the chest for draining while taking up a minimum of space within the chest.

The invention can also be constructed of metal to improve the heat transfer between the compartments 26'. If constructed of metal, the partitions 16 would preferably be welded or soldered into the liner 22 to provide for watertight integrity of the compartments 26', and the entire liner/insert would preferably be painted or coated with a corrosion resistant coating, e.g., a urethane based paint.

Figure 7:
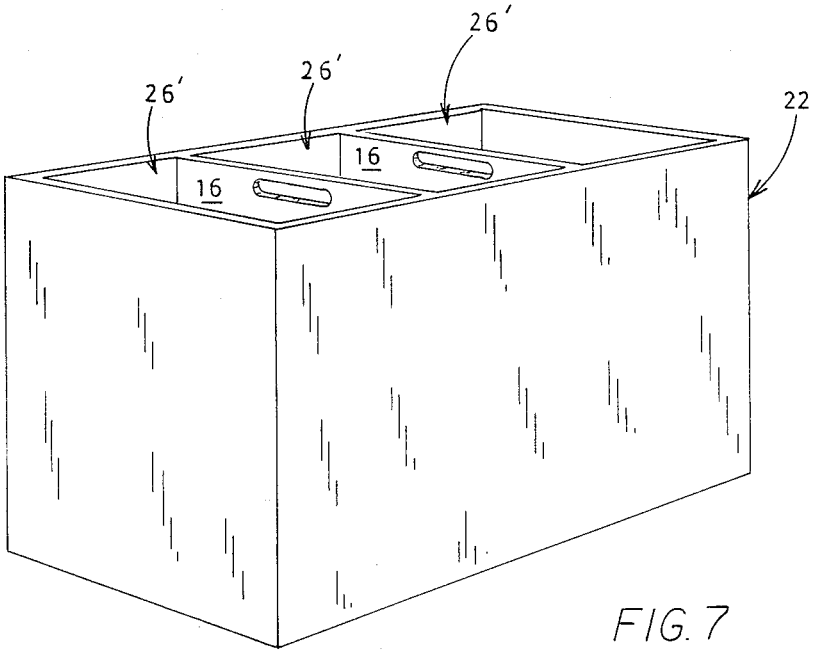
FIG. 7 illustrates a perspective view of an alternate embodiment of a combination liner/insert constructed in accordance with various features of the present invention.

In other embodiments of the invention, a plurality of partitions can be utilized to segregate the liner into more than two watertight compartments. In FIG. 7, an alternate embodiment having two partitions 16 which segregate the liner 22 into three watertight compartments 26' is shown. In this embodiment of the invention, ice or other cooling medium can be placed in the center compartment with articles to be chilled or kept cold stored in either of the end compartments. Ice can also be placed in an end compartment with articles to be chilled stored in the center compartment and articles which only need to be kept cool and dry stored in the other end compartment.

Figure 8:
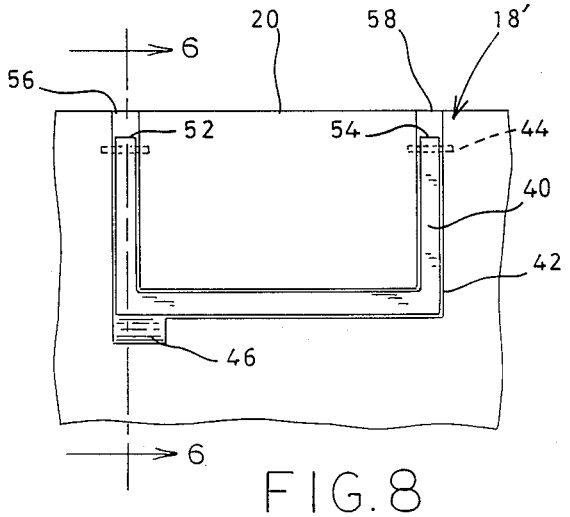
FIG. 8 illustrates a front elevation view of a portion of the partition of a combination liner/insert constructed in accordance with various features of the present invention, showing an alternate embodiment of the handle thereof.
Figure 9:
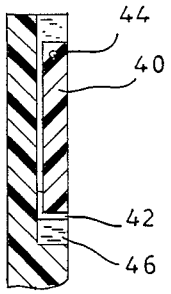
FIG. 9 illustrates a sectional view of FIG. 8 along lines 6—6.
Figure 10:
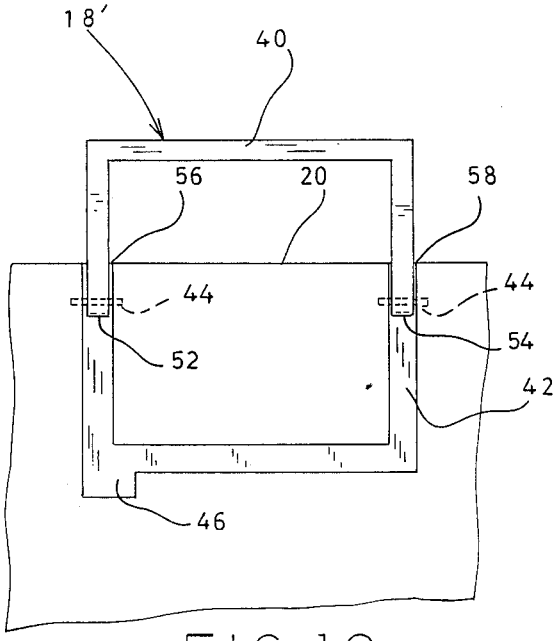
FIG. 10 illustrates the handle shown in FIG. 8 in the deployed position.

An alternate embodiment of the handle is shown generally at 18' in FIG. 8'. In this embodiment, a recessed handle 40 is provided. The handle 40 is U-shaped with first and second end portions 52 and 54, respectively, and is hingably attached to the partition 16 proximate its top edge 20. A recess 42 is provided in the partition 16 for receiving the handle 40 therein. Hinge pins 44 are provided for securing the handle 40 to the partition 16 within the recess 42 proximate the first and second end portions, 52 and 54, respectively, of the handle 40. The recess 42 further defines two notches 56 and 58 in the top edge 20 of the partition 16. In its deployed position, the handle 40 extends through the notches 56 and 58 as shown in FIG. 10. In its stored position, the handle 40 lies flush within the recess 42 of the partition 16 as shown in FIGS. 8 and 9. The recess 42 further defines a notch 46 for receiving a user's finger when the handle 40 is being deployed. This embodiment has the advantage of providing a partition without any penetration as compared with handle means in the embodiments shown in FIGS. 1 through 7.

While a preferred embodiment has been shown and described, it will be understood that it is not intended to limit the invention to such disclosure, but rather it is intended to cover all modifications and alternate constructions falling within the spirit and the scope of the invention as defined in the appended claims.

We claim:

1. An improved device for the refrigerated storage of materials, which comprises:

a top-opening refrigerated container having a bottom and side walls that define an interior volume;

a liner having a base and walls dimensioned to be releasably received within said interior volume of said container, said walls being contiguous with said side walls of said container, said base and walls of said liner defining an interior volume of said liner and an opening into said liner;

partition means for dividing said liner into at least two compartments, said partition means being a thin wall extending between opposite walls of said liner and perpendicularly from said base of said liner toward said opening of said liner and having a top edge proximate said opening, said partition means segregating said interior volume of said liner into a plurality of compartments having watertight integrity with respect to each other; and handle means defined by said partition means for selectively removing and inserting said liner from and into said container.

2. The liner of claim 1 wherein said handle means comprises said partition means having a hole located proximate said top edge of said partition means, said hole being dimensioned to receive the fingers of a human hand.

3. The liner of claim 1 wherein said handle means comprises a U-shaped handle hingably attached to said partition means proximate its said top edge.

4. The liner of claim 3 wherein said handle means is recessed within said partition means.

5. A combination liner/insert for segregating a top-opening refrigerated container such as a portable ice chest into a least two compartments and for protecting the interior of said container against damage caused by substances or articles placed therein, comprising:

liner means having a base and walls, said walls defining an opening opposite said base, said base, walls and opening defining an interior volume of said liner means, said liner means dimensioned to be received with said interior of said refrigerated container;

partition means for dividing said liner means into at least two compartments, said partition means comprising a thin wall extending between opposite walls and perpendicularly from said base of said liner means toward said opening of said liner means and having a top edge proximate said opening of said liner means, said partition means segregating said interior volume of said liner means into a plurality of compartments having watertight integrity with respect to each other; and handle means defined by said partition means for selectively removing and inserting said liner/insert from and into said container, said handle means being recessed within said partition means and having a U-shaped handle hingably attached to said partition means proximate said top edge of said partition means.

6. The liner/insert of claim 5 wherein said liner means and said partition means comprise integrally molded plastic.

7. The liner/insert of claim 5 wherein said liner means and partition means are fabricated from metal, thereby increasing the heat transfer between said compartments.

8. A combination liner/insert for segregating a preselected top-opening ice chest into two watertight compartments and for protecting the interior of said ice chest against damage caused by substances or articles placed therein comprising:

a liner, said liner having a base and walls comprised of relatively thin molded plastic dimensioned to substantially define the interior dimensions of said ice chest for being closely received therein, said walls further defining an opening substantially conforming to the opening of said ice chest;

partition means integrally molded within said container, said partition means comprising a wall of approximately the same thickness as said liner walls and being substantially vertically disposed extending from the base of said liner toward said opening of said liner, perpendicular to said base and said opening of said container, thereby segregating said container into two watertight compartments, said partition means having a top edge portion proximate said opening of said liner; and handle means comprising said partition means having a hole located proximate its said top edge portion, said hole being dimensioned to receive the fingers of a human hand.

* * * * *